US006257442B1

(12) United States Patent
Fredmark

(10) Patent No.: US 6,257,442 B1
(45) Date of Patent: Jul. 10, 2001

(54) PACKAGING STRUCTURE OF VARIABLE VOLUME

(75) Inventor: Lars Fredmark, Huddinge (SE)

(73) Assignee: UPC United Products Company AB, Huddinge (SE)

( * ) Notice: Subject to any disclaimer, the term of this patent is extended or adjusted under 35 U.S.C. 154(b) by 0 days.

(21) Appl. No.: 09/147,532

(22) PCT Filed: Jul. 15, 1996

(86) PCT No.: PCT/SE96/00957

§ 371 Date: Jan. 15, 1999

§ 102(e) Date: Jan. 15, 1999

(87) PCT Pub. No.: WO98/02359

PCT Pub. Date: Jan. 22, 1998

(51) Int. Cl.[7] ..... B65D 25/00
(52) U.S. Cl. ..... 220/914
(58) Field of Search ..... 220/6, 9.1, 9.2, 220/9.3, 9.4

(56) References Cited

U.S. PATENT DOCUMENTS

| | | | | |
|---|---|---|---|---|
| 1,155,475 | * | 10/1915 | Fay | 220/9.3 |
| 2,020,766 | * | 11/1935 | Brown | 220/9.3 |
| 2,182,932 | * | 12/1939 | Sanford | 220/9.2 |
| 2,638,399 | * | 5/1953 | Seymour | 220/9.3 |
| 3,094,361 | * | 6/1963 | Poyer | 220/9.2 |
| 3,096,923 | | 7/1963 | Piller | 229/49 |
| 3,265,284 | | 8/1966 | Tompkins | 229/49 |
| 3,286,752 | * | 11/1966 | Duryee Jr. | 220/9.3 |
| 3,410,328 | * | 11/1968 | Sasai | 220/9.2 |
| 4,646,802 | * | 3/1987 | Basore et al. | 220/9.3 |
| 5,667,066 | * | 9/1997 | Simpson | 220/9.3 |

FOREIGN PATENT DOCUMENTS

| | | |
|---|---|---|
| 3440123 | 5/1986 | (DE) . |
| 2077841 | 11/1971 | (FR) . |

OTHER PUBLICATIONS

Switzerland 95001780 A (UPC United Products Company AB), Jul. 20, 1996, Figure 1, abstract.

* cited by examiner

*Primary Examiner*—Joseph M. Moy
(74) *Attorney, Agent, or Firm*—Jacobson Holman, PLLC

(57) ABSTRACT

A transport packaging structure of variable volume having four generally parallel and mutually adjacent angle-pieces. Each angle piece has two flanges which define an angle of generally 90° therebetween such as to form an inner corner which faces towards the interior of the structure. Mutually adjacent angle-pieces on at least three sides of the packaging structure are held together by at least one arm which functions to enable two angle-pieces to be spaced apart by a selective distance.

16 Claims, 2 Drawing Sheets

PACKAGING STRUCTURE OF VARIABLE VOLUME

BACKGROUND OF THE INVENTION

1. Field of the Invention

The invention relates to a variable volume transport packaging structure of the kind defined in the preamble of claim 1.

2. Description of the Related Art

So-called disposable paperboard cartons and the like are at present used to a large extent in packaging an assortment of products for transportation. These disposable cartons or boxes are bulky and when their contents have been removed and placed on display shelves in the store or shop concerned, it is necessary to dispose of the empty carton in some appropriate manner. This disposal is a relatively complex operation, since the person concerned must first cut the packaging material so that it can be folded to a minimum volume, and thereafter sent to a waste recycling plant, for environmental reasons. The use of disposable cartons and boxes is both complicated and expensive.

SUMMARY OF THE INVENTION

Accordingly, one object of the invention s to provide a transport packaging structure of variable volume that can be used to package many different types of goods units with corresponding variations in size. Another object of the invention is to provide a packaging structure that can be adapted to goods units of rectangular cross-section and of different sizes and different width/height cross-sectional ratios. Still another object of the invention is to provide a packaging structure that can be collapsed to a relatively small storage volume which will facilitate transportation of the empty or collapsed packaging structure to a recycling station or the like in which the packaging structure can be destroyed, recycled or reused.

Yet another object of the invention is to provide a packaging structure that can be used as an auxiliary means which will enable the contents of the package (normally in the form of a plurality of consumer packages) to be moved to a display station, such as a display shelf or the like in a store or shop, without needing to leave the actual packaging structure in place until all of its contents have been removed.

These objects are achieved either fully or partially with a transport packaging structure of variable volume having four generally parallel and mutually adjacent angle pieces, each having two flanges which define an angle of generally 90° therebetween so as to form an inner corner which faces towards the interior of the structure. Mutually adjacent angle-pieces on at least three sides of the packaging structure are held together by at least one arm which functions to enable the two angle-pieces to be spaced apart at a selective distance therebetween.

According to further developments of the inventive packaging structure, arms may be provided on all four sides of the structure, mutually connecting adjacent angle-pieces, and the ends of the arms may be pivotally connected to respective angle-pieces. The arms may further be hinged between their respective ends, the arm links connected to the hinge being pivotal in a plane which lies adjacent to and parallel with the adjacent side of the packaging structure. In another embodiment, an arm may be provided at each end-part of one side of a packaging structure. In a further embodiment, the arms on one side of the packaging structure may function to hold the mutually facing legs of the angle-pieces essentially in a common plane. The structure may include locking means for locking the angle-pieces in mutually adjusted positions, particularly when the angle-pieces are fitted on the corner edges of a goods unit. Such locking means may include a securing band which surrounds the angle-pieces coacting with the goods unit. The structure may further be embodied with panels placed between pairs of mutually adjacent angle-pieces such as to form structure side walls, and may further include an end panel which covers the free cross-sectional space of the structure and which is removably fitted to one end of the packaging structure.

The invention is based on the realization that articles of a generally parallelepipedic shape and of rectangular cross-section can be packaged for transportation with the aid of four angle-pieces that are disposed to receive a respective corner edge of the article, such that one angle-piece receives a respective corner of the article as seen in cross-section. These angle-pieces shall therewith be held together to form a coherent unit. This is achieved by mutually connecting adjacent angle-pieces that delimit one and the same side of the article cross-section with a connecting and holding device that is connected at its ends to said two angle-pieces and which is adapted to permit the distance between said adjacent angle-pieces to be selectively adjusted. Such holding devices may be placed between all pairs of mutually adjacent angle-pieces, i.e. on all four sides of the goods cross-section, although it will be undersized that one side of such a holding device may be left free. The angle-pieces of the transport packaging structure can be brought readily into engagement with a respective corner edge of a goods unit by mutual parallel displacement of said angle-pieces, whereafter the angle-pieces can be fixed in position in relation to the packaged goods unit by means of a locking device. This locking device may have the form of a lashing, a bundle strap, securing straps, packaging tape or the like wound externally around the goods-holding angle-pieces in their longitudinal direction. When a thus packaged unit is transported to the place at which the packaged goods unit shall be removed, the package is easily opened by simply removing the locking device and lifting the package in the longitudinal direction of the angle-pieces. When the holding devices have the form of arms whose ends are coupled to respective angle-pieces by virtue of frictional forces acting therebetween, the arms are able to hold together the angle-pieces although with limited friction between said angle-pieces and the packaged articles when removing the locking device. This enables the transport packaging structure to form guide means which enables the packaged unit to be pushed or pulled axially from the packaging structure. This is of particular interest when the goods unit is comprised of a stack of packaging units or stacks of small packages (consumer packages) that lie side-by-side, irrespective of whether the stacks shall be pushed horizontally onto a shelf or shall be stacked vertically in a storage box, for instance in a chest freezer.

In preferred embodiments of the invention, the holding devices have the form of arms that are hinged at at least one position between the ends thereof connected to the angle-pieces, this hinge enabling its associated arm to be collapsed generally in the plane defined by the adjacent side surface of the goods unit.

Embodiments at present preferred include two such arms disposed on each main side of the transport packaging structure, said arms being conveniently disposed in the proximity of a respective end of the angle-pieces.

The angle-pieces preferably consist of L-profiles of mutually equal lengths.

The angle-pieces may be held together by securing elements connected between diagonally opposing angle-pieces at the ends of said angle-pieces. A pair of such crossing securing elements at each end of the packaging structure will not only provide a means of locking the angle-pieces together in their individual positions, but will also prevent movement of an enclosed goods unit in the longitudinal direction of the angle-pieces.

In one embodiment of the invention, panels are placed between mutually adjacent pairs of angle-pieces, so as to form a rectangular packaging tube together with said angle-pieces. Naturally, end panels can be placed between the side panels at the ends of the angle-pieces, such that the side panels and end panels define a parallelepipedic container which is held together by the transport packaging structure, which in this case also functions to completely shield the enclosed goods unit from the surroundings. The panels also form reinforcements which prevent parallel movement of the angle-pieces towards one another by external forces.

The arms are preferably bevelled along their longitudinal edges, so that the arms will be guided into an overlapping relationship without interfering with each other as the arms are dropped partially in over one another. The flanges of the angle-pieces will also preferably be bevelled, so as to enable said angle-pieces to slide in over one another as they are moved parallel and into contact with each other, wherein the bevels on the arms and the angle-piece flanges may be arranged to guide said arms and said flanges onto one another as the packaging structure is collapsed to a maximum collapsed state, instead of said arms and flanges colliding rigidly with one another.

The locking means used to hold the packaging structure together may comprise a screw joint or a clamp joint which function to fixate the arms in a set configuration relative to the angle-pieces and relative to one another by frictional forces. However, the locking device will preferably have the form of one or more straps tightened around the angle-pieces in a manner to hold said angle-pieces firmly on the corner edges of the enclosed goods unit. Disposable strap means may be used in this respect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be described in more detail with reference to exemplifying embodiments thereof and also with reference to the accompanying drawing, in which

DETAILED DESCRIPTION OF THE PREFERRED EMBODIMENTS

Figure 1:
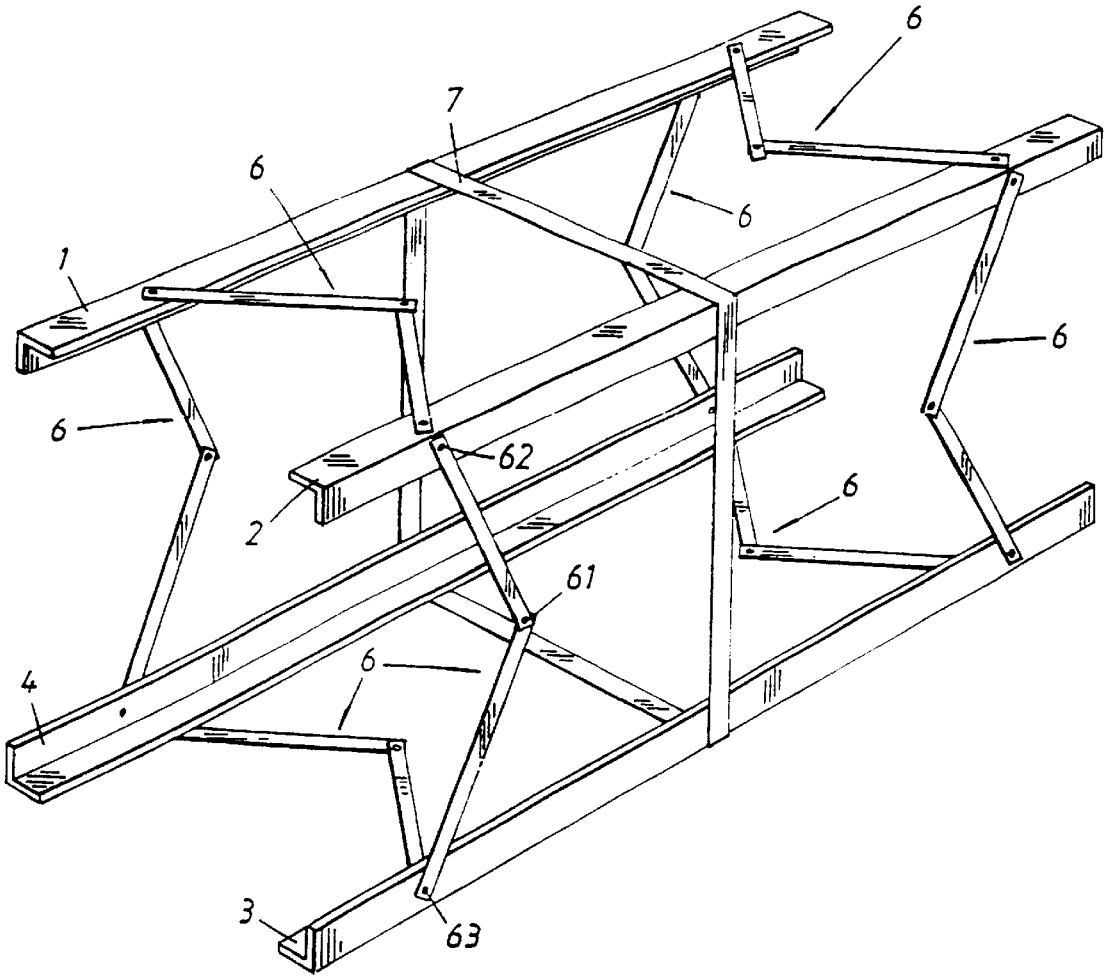
FIG. 1 is a perspective illustration of an inventive packaging structure.

The transport packaging structure illustrated in FIG. 1 is comprised of four angle-pieces 1–4 of essentially equal length and placed side-by-side. Each of the angle-pieces is formed by a straight elongated element having two flanges at right angles to one another, such as to define an inner corner which receives an outer corner of a goods unit (not shown in FIG. 1) to be packaged. Mutually adjacent angle-pieces 1, 2 are joined together by means of at least one arm 6. Respective arms are constructed to enable mutually adjacent angle-pieces to be selectively spaced at a given distance from one another.

In the FIG. 1 embodiment, arms 6 extend between all pairs of mutually adjacent angle-pieces, although it will be understood that arms 6 can be excluded between a pair of angle-pieces. The illustrated packaging structure is intended to receive a goods unit of generally rectangular and constant cross-section.

The goods unit may comprise a stack of rectangular objects, or four mutually adjacent stacks of objects which together form a goods unit and whose mutually parallel corner edges are received in a respective angle-piece 1–4. Also shown in FIG. 1 is a tightening or securing band 7 which extends around the four angle-pieces 1–4 so as to secure said angle-pieces against a goods unit packaged in the packaging structure.

However, it will be evident that the arms 6 may be constructed to be self-locking such as to maintain mutually adjacent angle-pieces at a fixed distance apart.

In the illustrated embodiment, the holding devices 6 have the form of arms which are hinged at 61 between their respective ends and pivotally connected at said ends 62, 63 to respective angle-pieces. The hinge 61 and the pivotal connections 62, 63 will preferably have parallel axes so as to enable the arms 6 to be folded in a plane which is parallel and lies adjacent a plane presented by the adjacent, generally parallel profiles between which the arms extend.

Figure 2:
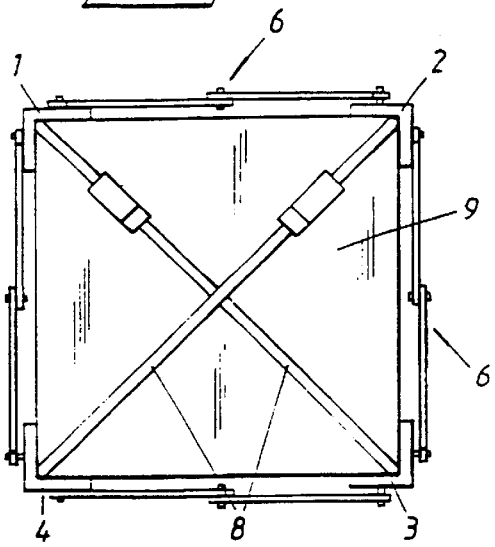
FIG. 2 is an end view of one embodiment of a packaging structure disposed around a goods unit.

FIG. 2 illustrates tensioning devices 8 that extend between diagonally opposite angle-pieces at their respective ends. A pair of such crossing tensioning devices at each end of the packaging structure forms a locking means which will firmly hold the angle-pieces 1–4 against an enclosed goods unit, said tensioning devices 8 also functioning to prevent the goods unit 9 from sliding from the transport packaging structure in the longitudinal direction of the angle-pieces 1–4.

Figure 3:
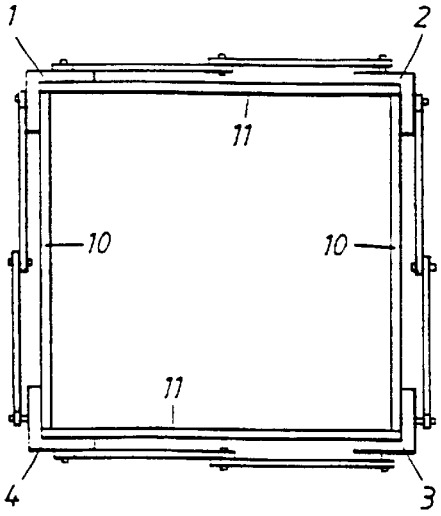
FIG. 3 is an end view of another embodiment of the transport packaging structure.

As illustrated in FIG. 3, panels 10, 11 may be placed within the packaging structure with the longitudinal edges of the panels received by the inner corners of the angle-pieces, such that these panels 10, 11 together with said angle-pieces 1–4 form a tubular packaging structure which is held together by locking means, such as tensioning straps 7, tensioning or tightening devices 8, or the like. An open or a closed container which places no requirements on the shape or nature of the goods can be obtained by fitting an end panel to one or both ends of the angle-pieces 1–4 (the short ends of panels 10, 11).

When the locking device has the form of a tensioning or tightening strap 7 (see FIG. 1), the tightening straps may be of a disposable kind and consist of so-called bundle straps, packaging tape, packaging bands, and so on.

As before mentioned, one holding device/arm 6 on each side of the transport packaging structure may be sufficient. The main purpose of the holding devices is to keep the angle-pieces 1–4 in generally parallel relationship and preferably juxtaposed, wherein the arms also function to maintain the angle-pieces mutually orientated to receive the corners of a goods unit of rectangular cross-section. To this end, the devices 6 are configured and mounted so that the two flanges with which an arm connects are held facing towards one another. In the case of an arm that has a hinge 61 between its respective ends and which is pivotally connected to respective angle-pieces 2, 3, this latter feature is achieved by arranging said hinges and pivots parallel with the perpendicularly opposing flanges so that the hinge/pivot axes will extend perpendicularly to the adjacent side of the goods unit to be packaged.

Figure 4:
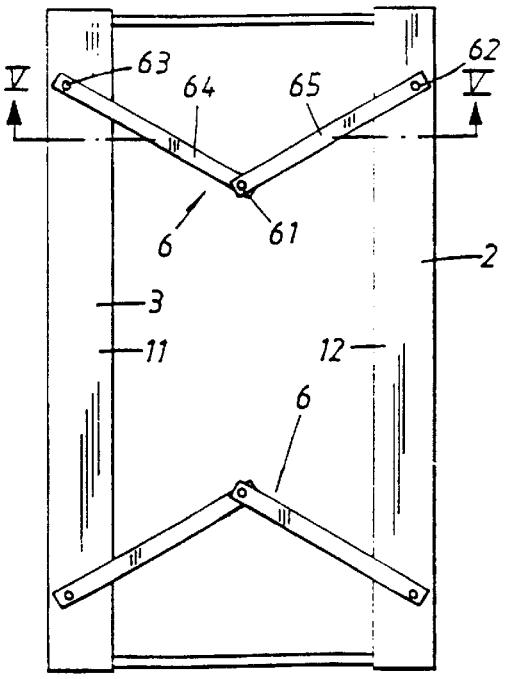
FIG. 4 illustrates schematically from above one side of the packaging structure.
Figure 5:
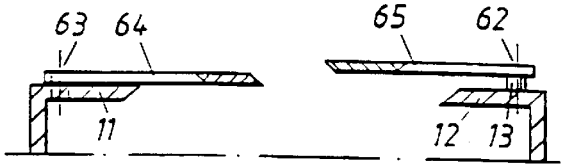
FIG. 5 is a sectional view taken on the line V—V in FIG. 4.

The arms 6 may be formed by elongated flat band-like elements which are connected to one another and to the angle-pieces by bolt joints or the like. As illustrated in FIGS. 4 and 5, the ends of the arm-links 64, 65 and the adjoining flanges 11, 12 of the angle-pieces may be bevelled to minimize the risk of the links 64, 65 interfering with the flanges 11, 12 when folded in over said flanges. The long edges of the inks 64, 65 are also preferably bevelled to counteract mutual interference when said links are folded-in towards one another. The mutually proximal end edges of the flanges 11, 12 of said angle-pieces 2, 3 may also be bevelled so as to enable the flange 12 to slide in beneath the flange 11 when the angle-pieces 2, 3 are moved close together. One link or arm 65 may also be mounted on its respective angle-piece flange 12 through the medium of a spacer element 13, so as to counteract interference between the mutually coacting components when the angle-pieces 2, 3 that define one side of the packaging structure are pushed towards each other.

The packaging structure is developed so that the inner corners of the angle-pieces 1–4 define a rectangular cross-sectional area which is larger than the cross-sectional area of a goods unit to be received by the packaging structure, whereafter the packaging structure is placed on the goods unit and the angle-pieces 1–4 then moved into engagement with respective outer corners of the goods unit, wherein, the illustrated arms 6 are folded around their respective hinges 61. The packaging structure is then secured with the aid of a bundle strap, tightening strap 7. The packaging structure and its contents can then be transported to a store or shop for instance, where the goods unit, for instance a stack of consumer articles or packages, is to be placed on a shelf for display or sale. The person performing this task can then simply cut the strap 7 and push the goods unit onto the shelf, with the unit guided by the angle-pieces 1–4. The transport packaging structure can then be collapsed to its minimum volume and sent back for reuse or recycling.

When the transport packaging structure lacks a holding device on one of its sides, the packaging structure may readily be placed sideways on the goods unit. When holding devices 6 are provided on all sides of the packaging structure, it is necessary to place the goods unit into the packaging structure from one end thereof.

It will be understood that the transport packaging structure can be readily adapted to different rectangular sizes and height/width ratios in respect of the cross-section of the goods unit to be packaged, and that the goods unit may have a length essentially equal to the length of the angle-pieces 1.

The person skilled in this art will realize that the inventive transport packaging structure can be erected and collapsed very easily, and that its volume can be varied greatly in a simple and expedient manner.

What is claimed is:

1. A transport packaging structure of variable volume comprising four generally parallel and mutually adjacent angle-pieces, each having two flanges which define an angle of generally 90° therebetween such as to form an inner corner which faces towards the interior of said structure, wherein pairs of mutually adjacent angle-pieces on at least three sides of the packaging structure, each pair defining one side, are respectively held together by at least one arm which functions to enable the respective pair of adjacent angle-pieces to be spaced apart at any selective distance ranging between and including a fully extended position and a fully contracted position therebetween, each arm having at least two arm links that are connected to one another at one end by a pivoting hinge and pivotally connected at a second end to a respective angle-piece such that said structure can be expanded and contracted in two mutually perpendicular directions, and further comprising a locking element separate from said arms for locking the angle-pieces in any mutually adjusted position defining said selective distance.

2. The structure according to claim 1, wherein arms are provided on all four sides of the structure, such as to mutually connect adjacent angle-pieces.

3. The structure according to claim 1, wherein the locking element includes tensioning devices extending between diagonally opposed angle-pieces, for firmly drawing said angle-pieces inward into engagement with an outside surface of a goods unit contained within said structure.

4. The structure according to claim 1, wherein the arm links connected to said hinge are pivotal in a plane which lies adjacent to and parallel with an adjacent side of the packaging structure.

5. The structure according to claim 1, wherein an arm is provided at each end-part of one side of said packaging structure.

6. The structure according to claim 1, wherein arms on one side of said packaging structure hold the mutually facing legs of the angle-pieces essentially in a common plane.

7. The structure according to claim 1, wherein the locking element includes a securing band which surrounds the angle-pieces, said angle-pieces being pushed inward by said locking element into engagement with an outside surface of a goods unit contained within said structure.

8. The structure according to claim 1, further comprising panels placed between pairs of mutually adjacent angle-pieces such as to form structure side walls.

9. The structure according to claim 1, further comprising an end panel which covers the free cross-sectional space of the structure and which is removably fitted to one end of the packaging structure.

10. A transport packaging structure of variable volume constructed to contain a goods unit within an interior of said structure, said structure comprising:

four generally parallel and mutually adjacent angle-pieces defining four sides of the structure, each having two flanges which define an angle of generally 90° therebetween such as to form an inner corner which faces towards the interior of said structure to coact with the goods unit, a pair of any two mutually adjacent angle-pieces defining one side of the structure;

at least one hinged arm on each of at least two sides of the packaging structure, each hinged arm enabling a respective pair of adjacent angle-pieces forming one side to be spaced apart at a variable selective distance such that said structure is adjustable to enclose a plurality of goods units of different sizes, with said angle pieces, when properly adjusted, being in snug engagement with respective outer surfaces of said enclosed goods units; and a locking element separate from said hinged arms and acting in conjunction with said angle pieces for preventing said pairs of angle-pieces, once adjusted, from separating beyond said variable selective distance.

11. The structure as set forth in claim 10, wherein said locking element comprises a securing band surrounding an outer surface of the angle-pieces for pressing the inner corners of said angle-pieces into firm engagement with an enclosed goods unit.

12. The structure as set forth in claim 10, wherein said locking element comprises tensioning devices extending between diagonally opposing angle-pieces, for firmly drawing said angle-pieces inward against an enclosed goods unit.

13. A transport packaging structure of variable volume containing a goods unit within an interior of said structure, said structure comprising:

four generally parallel and mutually adjacent angle-pieces, each having two flanges which define an angle of generally 90° therebetween such as to form an inner corner which faces towards the interior of said structure to engage an outer surface of said goods unit contained therein, a pair of any two mutually adjacent angle-pieces defining one of four sides of the structure;

at least one arm on each of the four sides of the packaging structure, each arm connecting and enabling a respective pair of adjacent angle-pieces on the four sides to be spaced apart at a selective distance and essentially in a common plane, each arm having at least two arm links hingedly connected to one another and pivotally connected to a respective angle-piece to allow said structure to be expanded and contracted in two mutually perpendicular directions, and each arm having a fully extended position and a fully contracted position; and a locking element separate from said hinged arms for tensioning said angle pieces into engagement with said enclosed goods unit at said selective distance which is any selected position between and including said fully contracted position and said fully extended position, said selected position being dictated by an outer dimension of said enclosed goods unit against which said angle pieces are tensioned to engage.

14. The structure as set forth in claim 13, wherein said locking element comprises a securing band surrounding an outer surface of the angle-pieces for pressing the inner corners of said angle-pieces into firm engagement with said enclosed goods unit.

15. The structure as set forth in claim 13, wherein said locking element comprises tensioning devices extending between diagonally opposed angle-pieces, for firmly drawing said angle-pieces inward against said enclosed goods unit.

16. The structure as set forth in claim 13, further comprising panels placed between pairs of mutually adjacent angle-pieces on an inner surface of respective flanges to form structure side walls.

* * * * *